US007164233B2

(12) United States Patent
Bryant et al.

(10) Patent No.: US 7,164,233 B2
(45) Date of Patent: Jan. 16, 2007

(54) BARIUM-SILICA GLASS LAMP HAVING THERMALLY BALANCED LEAD-IN WIRES

(75) Inventors: Johnny D. Bryant, Cookeville, TN (US); Paul R. Pumphrey, Cookeville, TN (US)

(73) Assignee: Federal Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/023,934

(22) Filed: Dec. 28, 2004

(65) Prior Publication Data

US 2006/0028143 A1 Feb. 9, 2006

Related U.S. Application Data

(60) Provisional application No. 60/598,644, filed on Aug. 4, 2004.

(51) Int. Cl.
*H01J 17/16* (2006.01)

(52) U.S. Cl. ..... 313/636; 313/634; 313/635; 313/639; 313/638

(58) Field of Classification Search ..... 313/636, 313/634, 631, 643, 642, 641, 640, 639, 638, 313/637
See application file for complete search history.

(56) References Cited

U.S. PATENT DOCUMENTS 4,238,705 A 12/1980 Thomas
4,441,051 A 4/1984 Thomas
5,659,222 A 8/1997 Ragsdale et al.
5,754,005 A 5/1998 Sakoske et al.
5,867,786 A 2/1999 Ishi
6,362,568 B1 * 3/2002 Anderson et al. ..... 313/623
6,461,427 B1 * 10/2002 Phillips et al. ..... 117/13
6,469,443 B1 10/2002 Bryant et al.
2003/0111958 A1 6/2003 Claus et al.
2004/0070344 A1 * 4/2004 Fujioka et al. ..... 313/633

FOREIGN PATENT DOCUMENTS

JP 01299792 A * 12/1989

* cited by examiner

*Primary Examiner*—Joseph Williams
*Assistant Examiner*—Hana Asmat Sanei
(74) *Attorney, Agent, or Firm*—Dickinson Wright PLLC

(57) ABSTRACT

An automotive lamp has a sealed envelope of barium silica glass that is essentially free of cadmium and in which a light emitting element is contained. Lead-in wires extend through the envelope and are coupled to the light emitting element. The glass envelope and lead-in wires have respective coefficients of thermal expansion over a temperature range form ambient to 520° C. which closely match one another to minimize stress and cracking of the envelope at the interface.

6 Claims, 2 Drawing Sheets

BARIUM-SILICA GLASS LAMP HAVING THERMALLY BALANCED LEAD-IN WIRES

This application claims priority to U.S. Provisional Patent Application No. 60/598,644, filed Aug. 4, 2004.

BACKGROUND OF THE INVENTION

1. Technical Field

This invention relates generally to incandescent light bulbs used for automotive applications.

2. Related Art

U.S. Pat. No. 6,469,443 discloses an incandescent light bulb for use in automotive turn signal applications in which light-emitting elements are sealed within a glass envelope and are coupled electrically by lead-in wires which pass through the envelope to the exterior thereof for connection with a source of electrical energy. The glass envelope is a barium silicate based glass that is essentially free of cadmium and includes a certain amount of strontium to give the glass an amber color. While such envelope material has shown to be useful for its intended purpose, it has been found that the glass material is generally incompatible with many of the existing lead-in wire materials such that over the course of repeated heating and cooling cycles of the lamp assembly, the lead-in wires are caused to separate and then reengage the envelope material so as to introduce a build-up of stress, cracking and/or failure of the envelope glass at the interface of the lead-in wires and envelope. It is an object of the present invention to overcome or greatly minimize the disadvantages associated with employing barium silica glass envelopes for such lighting applications.

SUMMARY OF THE INVENTION AND ADVANTAGES

A lamp assembly constructed according to the invention comprises a sealed envelope of glass in which a light emitting element is housed and coupled electrically to at least one lead-in wire which passes through the envelope. The lead-in wire has a predetermined coefficient of thermal expansion over a temperature range from ambient to 520° C. The glass envelope is fabricated of barium silica glass that is essentially free of cadmium and which has a coefficient of thermal expansion over the same temperature range which is about the same as that of the lead-in wires so as to preclude a build up of stress, separation, cracking or failure at the interface of the lead-in wires and the envelope during repeated heating and cooling cycles of the lamp assembly.

The invention thus provides the advantage of a barium silica glass envelope that is essentially free of cadmium matched with lead wires whose coefficient of thermal expansion closely matches that of the glass envelope material over the range of temperature so as to expand and contract together with the glass envelope material to minimize stress and possible failure to incompatible coefficients of thermal expansion between the two.

According to a further advantage of the invention, and to a particular further aspect in the invention, it has been found that a nickel-chromium-iron based alloy material for the lead-in wires is compatible in its thermal characteristics to that of the glass envelope material and, according to still a further particular aspect, an alloy which the composition contains about 42.5 wt. % nickel, 5.75 wt. % chromium, 0.5 wt. % manganese, 0.25 wt. % silicon, 0.07 wt. % max carbon and the balance iron. Such material over the temperature range exhibits essentially the same thermal coefficient characteristics as that of the glass material over the temperature range. To the extend there is deviation, it is not sufficient to cause any performance problems.

BRIEF DESCRIPTION OF THE DRAWINGS

These and other features and advantages of the present invention will become more readily appreciated when considered in connection with the following detailed description and appended drawings, wherein.

DETAILED DESCRIPTION

Figure 1:
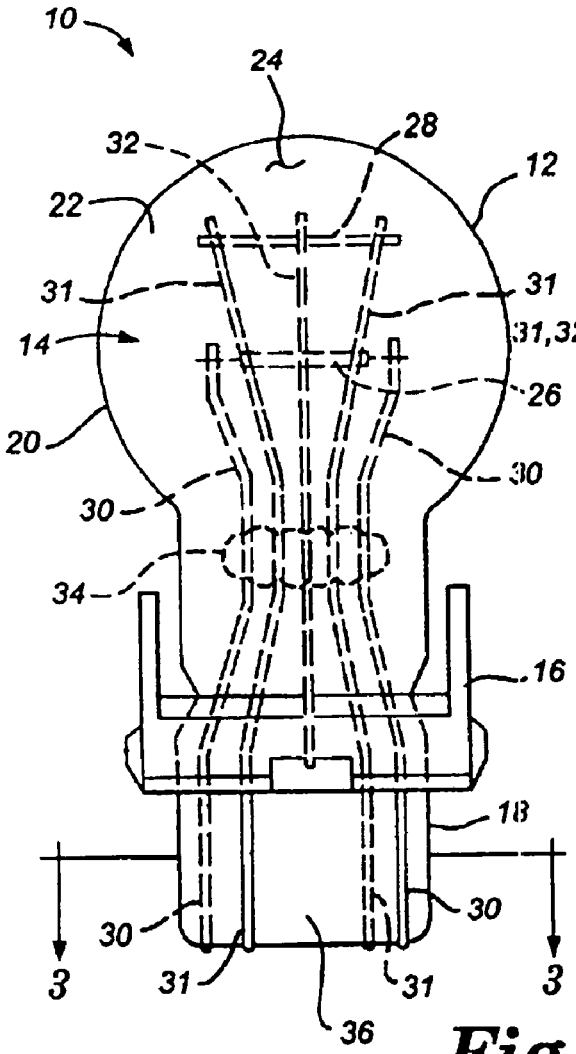
FIG. 1 is a front elevation view of an automotive lamp constructed in accordance with a presently preferred embodiment of the invention.
Figure 2:
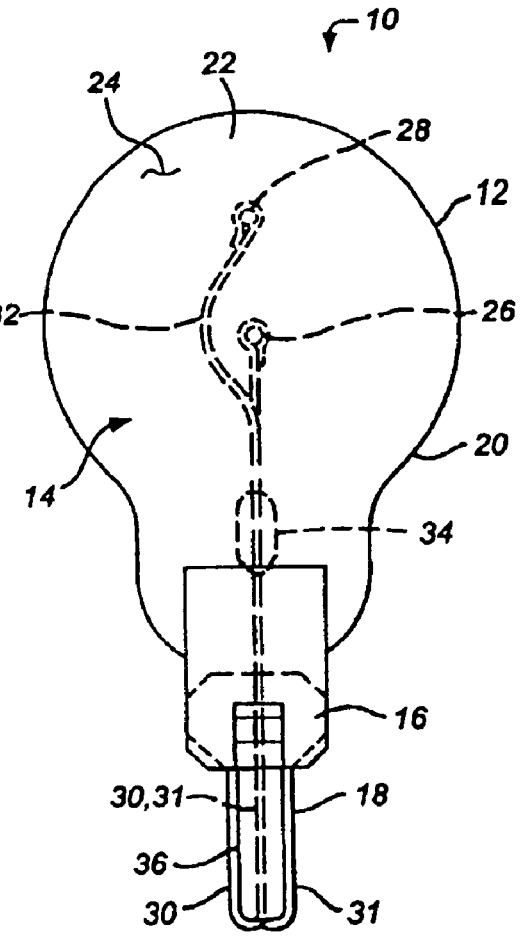
FIG. 2 is a side elevation view of the lamp of FIG. 1.

Referring to FIGS. 1 and 2, there is shown a lamp 10 which, in general, comprises a sealed glass envelope 12 containing a filament assembly 14 and supporting an outer sleeve 16. Such a lamp 10 is typically used in vehicular applications, and more particularly automotive vehicles. As such, the term "automotive lamp" refers to a lamp that meets one or more automotive regulations or standards for the lamp. Such regulations and standards are well known to those skilled in the art. The envelope 12 is formed from glass and includes a sealed lower portion 18 and an upper portion 20 having a sealed interior region 22 in which there is provided an inert gas fill 24.

The filament assembly 14 includes a pair of filaments 26, 28, a number of lead-in or support wires 30–32, and a glass bridge 34 that maintains electrical isolation of the lead-in wires while providing additional structural support for the entire filament assembly 14. The two filaments 26, 28 are spaced from each other within the interior region 22 and can be independently operated and can be used to provide two different levels of lamp illumination, as is well known. The lower filament 26 is supported by lead-in wires 30 that extend downward from the filament 26, through the bridge 34 and into the sealed lower portion 18 which is in the form of a wedge base. These lead-in wires 30 extend through the wedge base 18 to an exposed location on the outside surface 36 of the glass envelope 12. In particular, they exit the wedge base at its lower most edge and run upward along the outer surface 36, terminating at a protected location underneath the outer sleeve 16. This construction provides a an exposed portion of the wires for electrical connection of the lamp in a circuit, and termination of the lead-in wires 30 underneath the outer sleeve helps prevent the exposed portion of the wires from being inadvertently bent outward away from the wedge base 18. The outer sleeve 16 is a resilient plastic piece that allows the lamp 10 to be securely, but removably, connected to a conventional socket (not shown) with the plastic sleeve cooperating with the conventional socket clip to retain the lamp within the socket in known manner. A suitable socket designed for the lamp 10 is disclosed in U.S. Pat. No. 5,486,991, the entire contents of which are incorporated herein by reference, but which are not essential to the invention.

Figure 3:
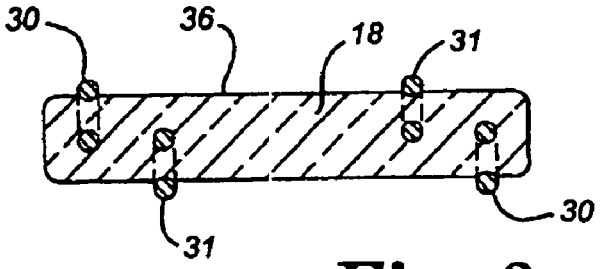
FIG. 3 is an enlarged cross-sectional view taken along lines 3—3 of FIG. 1.

The upper filament 28 is supported by lead-in wires 31 that are curved laterally as shown in FIG. 2 to maintain suitable spacing from filament 26, but that otherwise extend downward through the envelope 12 and to an exposed location on outer surface 36 in the same manner as wires 30. The configuration of lead-in wires 30 and 31 is it exits the wedge base 18 is more specifically shown in cross section in FIG. 3. Referring again to FIG. 1, the upper filament 28 is also supported by a third support wire 32 which provides mechanical support for the filament at its center. This wire 32 extends downwardly through the bridge 34 and into the wedge base 18, but is terminated there and does not extend to the exterior of the envelope since it is not used to provide operating power to the filament.

The glass that is used for the envelope is manufactured from a barium-silica-based glass that includes at least some amount of barium oxide. The glass composition may include other additives, such as coloring agents, as desired. For example, the glass may contain a certain amount of strontium oxide to give an amber color to the glass if desired. The glass may comprise, for example, the essentially cadmium-free barium-silica based glass including about 2 to 2.3 wt. % barium oxide and 5 to 6 wt. % strontium oxide, and may contain other constituents as well. Particular examples of some suitable family members can be found in U.S. Pat. No. 6,469,443, the disclosure of which is incorporated herein by reference.

To manufacture such a lamp, the glass is initially formed into an elongated tube, with the glass tube them being cut into segments of suitable length for manufacturing individual bulbs. One end of the segment of glass tube is softened using heat and then blown into a globe and then cut to make an individual bulb. This can be done using a mold with the tube being expanded by air pressure while it is softened to form the enlarged upper portion 20 shown in FIGS. 1 and 2. Then, the filament assembly 14 is inserted into the other end of the glass tube. This filament is pre-manufactured using the bridge 34 to hold the lead-in wires and filaments together as a single unit. Next, a sealed envelope is formed containing the light emitting element and this is done by heating and softening the open end of the envelope through which the lead-in wires extend and then sealing the open end closed by pinching the softened open end closed such that the light emitting element is contained inside in the sealed protective environment. This sealing can be done using a press to seal the glass together and form the wedge-shaped lower portion 18. For purposes of working the glass, its softening point is around 690° C. and can be worked at about 1150° C. Once formed, the lamp assembly is annealed by heating the assembly to about 482–520° C. (below the softening point) and then cooling the assembly at a controlled rate to relieve stress in the glass bulb.

Figure 4:
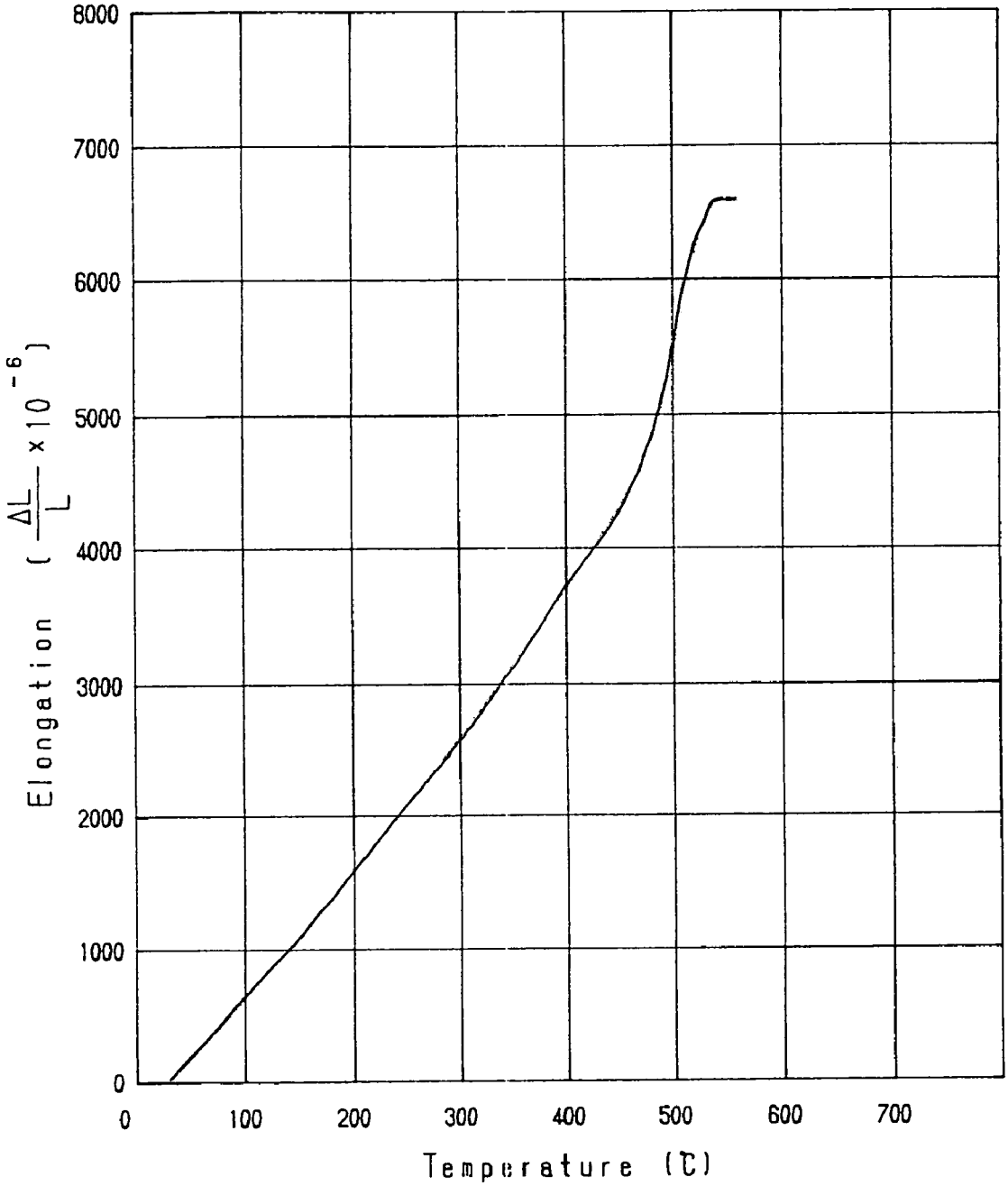
FIG. 4 is a graph representing the thermal expansion curve of the glass envelope material over a range of temperature.

The present invention recognizes that the family of barium-silica glass contemplated by the present invention has certain thermal expansion characteristics which are peculiar to this family of glass. During manufacturing and annealing and to a limited extend during operation, as the glass cools it contracts at a variable rate over the full temperature range (i.e., from ambient temperatures to the 1150° C. working temperature). It is further recognized that the lead-in wires 30, 31 which are embedded in the wedge-base 18 likewise expand and contract with changes in temperature. While, from an electrical conductivity standpoint, a number of materials would be suitable as lead-wire material, it has been found that a particular nickel-chromium-iron-based alloy which has thermal expansion characteristics which closely match that of the barium-silicate glass over the range of temperature from ambient to the maximum annealing temperature of 520° C. FIG. 4 illustrates an expansion curve for the barium-silica glass. The material for the lead-in wires 30, 31 has about the same expansion curve, although the lines may not be identical over the full temperature range, but are essentially identical over the range of the annealing temperature down to ambient temperature. The composition for the lead-in wires includes about 42.5 wt. % nickel, 5.75 wt. % chromium, 0.5 wt. % manganese, 0.25 wt. % silicon, 0.07 wt. % max of carbon, with the balance being iron. One such material for the lead-in wires is commercially available from Carpentry Technology Corporation under the trade designation "Car Tech 42-6". With the co-efficient of thermal expansion characteristics of the glass and lead-in wires being essentially the same, the materials expand and contract together at essentially the same rate over the temperature range, and thus eliminate or greatly minimize any stress induced to the glass in the regions of the lead-in wires due to mismatches in the coefficients during heating and cooling. As such, there is no tendency for the glass to be pulled away from the lead-in wires, as can occur when the thermal expansion characteristics are mismatched, which can cause a build up of stress, cracking and possible compromise of the sealed environment of the bulb.

Accordingly, the invention contemplates a barium-silica lamp bulb having lead-in wires with coefficient of thermal expansion characteristics closely matching that of the glass such that the two are compatible to prevent the build up of stress, cracking and failure at the interface between the glass and lead-in wires during heating and cooling cycles.

The preferred material for the lead-in wires is commercially available from Carpentry Technology Corporation under the trade designation "Car Tech 42-6".

Obviously, many modifications and variations of the present invention are possible in light of the above teachings. It is, therefore, to be understood that within the scope of the appended claims, the invention may be practiced otherwise than as specifically described.

What is claimed is:

1. A lamp assembly, comprising:

a sealed envelope of glass;

a light emitting element housed within said envelope;

at least one lead-in wire passing through said envelope and coupled electrically to said light emitting element and having a predetermined coefficient of thermal expansion over a temperature range from ambient to 520° C.;

wherein said sealed envelope is fabricated of barium silica glass that is essentially free of cadmium and which has a coefficient of thermal expansion over the temperature range of ambient to 520° C. which is about the same as that of said lead-in wires so as to preclude a build up of stress, separation, cracking or failure at the interface of said lead-in wires and said envelope during repeated heating and cooling cycles of said lamp assembly; and wherein said at least one lead-in wire has a composition of about 42.5 wt. % nickel, 5.75 wt. % chromium, 0.5 wt. % manganese, 0.25 wt. % silicon, 0.07 wt. % maximum carbon, and the balance essentially iron.

2. The assembly of claim 1 wherein said glass envelope contains no amount of cadmium.

3. The assembly of claim 1 wherein said glass envelope includes an amount of strontium oxide.

4. The assembly of claim 1 wherein said glass envelope includes about 2.3 wt. % barium oxide.

5. The assembly of claim 4 wherein said glass envelope includes strontium oxide.

6. The assembly of claim 5 wherein said strontium oxide is present in an amount equal to about 5 to 6 wt. %.

* * * * *

UNITED STATES PATENT AND TRADEMARK OFFICE

CERTIFICATE OF CORRECTION

PATENT NO. : 7,164,233 B2
APPLICATION NO. : 11/023934
DATED : January 16, 2007
INVENTOR(S) : Johnny D. Bryant and Paul R. Pumphrey It is certified that error appears in the above-identified patent and that said Letters Patent is hereby corrected as shown below:

Title Page, col. 2, line 6-7; Abstract Replace “form ambient” with -- from ambient --
Column 2 Line 2 Please replace “extend” with -- extent --
Column 2 Line 51 Please replace “a an” with -- an --
Column 2 Line 54 After “outer sleeve” insert --16 --
Column 2 Line 61 Replace “in known” with -- in a known --
Column 3 Line 4 After “wedge base 18” insert --and--
Column 3 Line 26 Replace “tube them” with -- tube then --

Signed and Sealed this

Third Day of April, 2007

JON W. DUDAS
*Director of the United States Patent and Trademark Office*